United States Patent [19]

Bugg

[11] Patent Number: 4,783,650

[45] Date of Patent: Nov. 8, 1988

[54] DATA DISPLAY ARRANGEMENT

[75] Inventor: Richard E. F. Bugg, Coulsdon, England

[73] Assignee: U.S. Philips Corp., New York, N.Y.

[21] Appl. No.: 21,560

[22] Filed: Feb. 27, 1987

Related U.S. Application Data

[63] Continuation of Ser. No. 643,339, Aug. 22, 1984, abandoned.

[30] Foreign Application Priority Data

Sep. 1, 1983 [GB] United Kingdom ..... 8323402

[51] Int. Cl.[4] ..... G09G 1/24

[52] U.S. Cl. ..... 340/748; 340/750; 340/789; 340/802

[58] Field of Search ..... 340/723, 735, 748, 750, 340/790, 789, 798, 802, 804; 358/147

[56] References Cited

U.S. PATENT DOCUMENTS

| | | | |
|---|---|---|---|
| 3,896,428 | 7/1975 | Williams | 340/731 |
| 4,158,837 | 6/1979 | Zahorsky | 340/798 |
| 4,297,693 | 10/1981 | Parsons | 340/790 |
| 4,384,285 | 5/1983 | Long et al. | 340/723 |
| 4,405,830 | 9/1983 | Foster et al. | 340/750 |
| 4,486,856 | 12/1984 | Heckel et al. | 340/798 |
| 4,504,828 | 3/1985 | Couper et al. | 340/748 |

FOREIGN PATENT DOCUMENTS 2048836 4/1982 United Kingdom .

*Primary Examiner*—Gerald L. Brigance
*Assistant Examiner*—Jeffery A. Brier
*Attorney, Agent, or Firm*—Thomas A. Briody; James J. Cannon

[57] ABSTRACT

A character display arrangement for displaying on a CRT rows of discrete characters. Digital codes represent both character data which identifies character shape and attribute data which identifies the attributes to be applied to displayed characters. The attribute data as received and stored in a display memory is in stack-coded form and relates to serial non-spacing attributes. The attribute and character data is read out from the memory one character row at a time. The character data is fed directly to a row buffer which has a position for each character position. The stack-coded attribute data is fed one group at a time to a pertaining fill register where it is decoded into explicit attribute data and fed to the row buffer to be associated with the character data. Once an attribute is set at a given position, it remains pertaining in the pertaining fill register and is fed into each succeeding character position until either a contradictory attribute is set at a subsequent character position in the character row or until the end of the character row.

4 Claims, 2 Drawing Sheets

DATA DISPLAY ARRANGEMENT

This is a continuation of application Ser. No. 643,339, filed 22, Aug. 1984, now abandoned.

BACKGROUND OF THE INVENTION

1. Field of the Invention

This invention relates to data display arrangements of a type for displaying on the screen of a raster scan display device data represented by digital codes, the displayed data being composed of discrete characters arranged in character rows each comprising a number of character positions.

2. Description of the Prior Art

A data display arrangement of the above type can include, in addition to the display device, acquisition means for acquiring transmission information which represents characters selected for display and also represents attributes for the characters, memory means for storing derived digital codes, a character memory in which is stored character information identifying the available character shapes which the arrangement can display, and attribute logic in which attribute data is operated on. This character information is selectively addressed in accordance with the stored digital codes and the information read out is used to produce character generating signals for the data display. Where, as would usually be the case, the display is on the screen of a CRT, this selective addressing is effected synchronously with the scanning action of the CRT.

The various attributes which can be applied to the characters as displayed, serve to enhance the display. Examples of attributes are "flashing", "underlining", "color choice", and "double height".

SUMMARY OF THE INVENTION

It is an object of the present invention to provide an improved method of associating character data and attribute data together prior to the selective read out of the character information.

According to the invention, there is provided a data display arrangement of the type set forth above in which said digital codes represent both character data which identifies character shape and attribute data which identifies at least one attribute to be applied to displayed characters, and there are included means for selectively displaying characters with their attributes in accordance with the received data; which arrangement is characterized in that said means includes attribute converter means whereby attribute data which is in "stack-coded" form and relates to serial non-spacing attributes (as hereinafter defined) is converted into fully explicit attribute data in respect of each character position.

BRIEF DESCRIPTION OF THE DRAWINGS

In order that the invention may be more fully understood, reference will now be made by way of example to the accompanying drawings, of which.

DESCRIPTION OF THE PREFERRED EMBODIMENT

Figure 1:
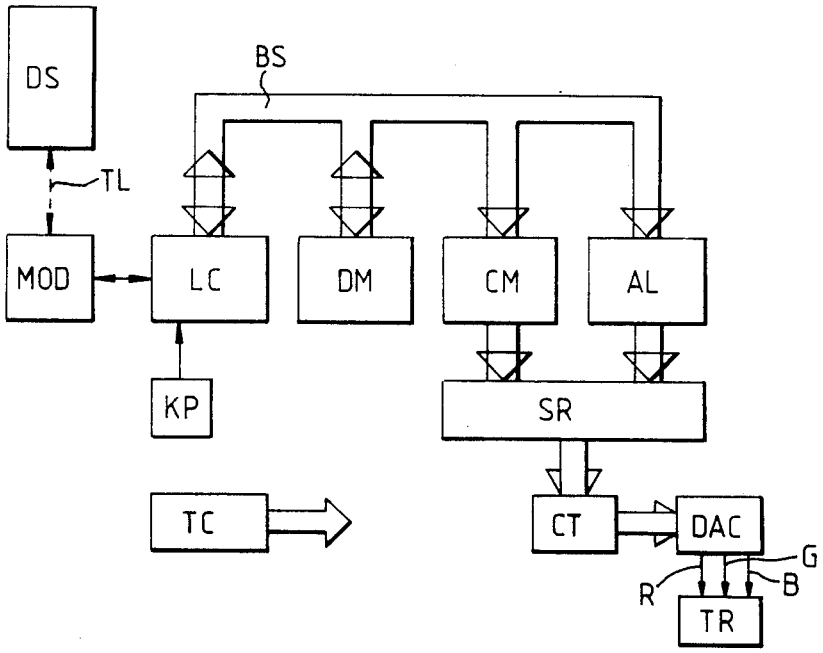
FIG. 1 shows diagrammatically a video display terminal having a data display arrangement in which the invention can be embodied.

Referring to the drawings, the video display terminal shown diagrammatically in FIG. 1 can be provided in a data display system which is used in conjunction with telephone data services that offer a telephone subscriber having the terminal at his premises the facility of access over the public telephone network to data sources from which data can be selected and transmitted in digitally coded form to the subscriber's premises for display on a television receiver. Examples of such telephone data services are the British and German videotex services Prestel and Bildschirmtext.

The video display terminal comprises a modem MOD by which the terminal has access over a telephone line TL (e.g. via a switched public telephone network) to a data source DS. A logic and processor circuit LC provides the signals necessary to establish the telephone connection to the data source DS. The circuit LC also includes data acquisition means for acquiring transmission information from the telephone line TL. A command keypad KP provides user control instructions to the circuit LC. A common address/data bus BS interconnects the circuit LC with a display memory DM, a character memory CM and attribute logic AL. Under the control of the circuit LC, digital codes derived from the received transmission information and representing characters for display and associated attributes are loaded onto the data bus BS and assigned to an appropriate location in the display memory DM. Thereafter, addressing and read out means in the circuit LC accesses the character and attribute data stored in the display memory DM and supplies modified data to address selectively the character memory CM and the attribute logic AL to produce character dot and attribute information. Shift registers SR receive this information and use it to drive a color look-up table CT to produce therefrom digital codes which are applied to a digital-to-analog converter DAC. The output signals from the converter DAC are the R,G,B character generating signals required for driving a television receiver TR to display on the screen thereof the characters represented by the display data. A timing circuit TC provides the timing control for the data display arrangement.

There is included in the addressing and read out means of the circuit LC a register and buffer arrangement which operates on character and attribute data read out from the display memory DM to supply the modified data used to address the character memory CM and the attribute logic AL. This operation serves to associate together explicitly the character and attribute data, as will now be considered.

Figure 2:
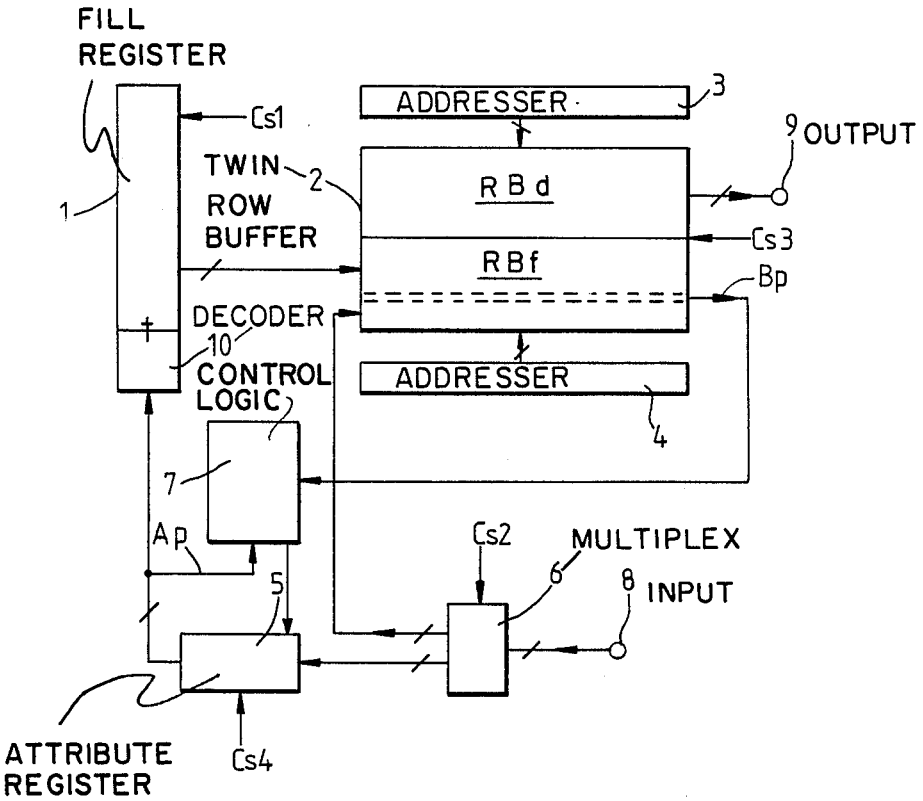
FIG. 2 shows diagrammatically a register and buffer arrangement according to the invention.

The register and buffer arrangement is shown in FIG. 2 and comprises a pertaining fill register 1, a twin row buffer 2, a "display" addresser 3, a "fill" addresser 4, an attribute FIFO (first-in-first-out) register 5, a multiplexer 6 and control logic 7. Character and attribute data from the display memory (DM-FIG. 1) is applied to the arrangement at an input 8, and the resulting display data is fed from the arrangement at an output 9.

The arrangement involves a technique known as "stack coding" by which a number of attributes can be grouped together and applied to one character position. A single "pointer" bit of the character data for a character position is used to signify that one or more attributes are to be grouped at the position, and a single "pointer"

bit of the attribute data is used to signify whether or not there are more attributes to come in a given group of attributes as the group is processed. Also, the arrangement is organized to process attributes which are both "serial" and "non-spacing". A serial attribute is deemed to be an attribute which applies from the character position for which it is set until the end of the character row, or until a contradictory attribute is encountered in the same character row. A non-spacing attribute is deemed to be an attribute which may be set at the same character position as that used for a character which is to be displayed.

Considering now the operation of the arrangement, before character and attribute data are applied from the external display memory to the input 8, the pertaining fill register 1 is cleared. A control signal Cs1 signifies this action. The register 1 has different groups of bit positions allotted to respective attributes. For instance, 5 bit positions may be allotted to "foreground" color to give a choice of 32 different foreground color, another 5 bit positions may be allotted to background color choice, and so on. When the register 1 is cleared the attributes (as represented by their respective groups of bit positions) are set to their so-called "default" values by appropriate bit values assumed at these positions. For instance, the default value of the "foreground" attribute may be the bit code for white.

The character and attribute data for one complete character row at a time is applied at the input 8. The character data is passed directly via the multiplexer 6 to the row buffer 2, and the attribute data is passed via the multiplexer 6 to the attribute register 5. A control signal Cs2 signifies the switching of the multiplexer 6 for this purpose. Once these two actions have been completed, it is no longer necessary to access the external display memory until the data for the next character row is required. The twin row buffer 2 has two buffers each of which can hold the character and attribute data for a complete display row of characters, and they function alternately as either a "fill" row buffer or as a "display" row buffer. In the drawing, RBd is assumed to be the current "display" row buffer and RBf the current "fill" row buffer. A control signal Cs3 signifies the switching of the two row buffers for their alternate functions for successively displayed rows of characters. The addresser 4 steps the fill row buffer RBf for the fill process and the addresser 3 steps the display row buffer RBd for the display process. This stepping is at different rates.

In the current fill row buffer RBf, a given bit in the same bit position of each of the character positions serves as a character point bit Bp and is applied to the control logic 7 when the character position is being addressed. If this character pointer bit Bp signifies that there are no attributes to be set at the first character position, then the (default) contents of the pertaining fill register 1 are transferred as attribute data to the first character position of the fill row buffer RBf. This attribute data is fully explicit in the sense that it relates only to the display of the character at the first character position. One bit of this attribute data overwrites the character pointer bit to cancel it. The fill row buffer RBf is stepped by the addresser 4 again for a second fill process which thereafter continues for succeeding character positions until the character pointer bit from a character position indicates that a group of one or more attributes are to be set at that position. The control logic 7 then causes the first (byte) of attribute data held in the attribute register 5 to be fed to the pertaining fill register 1. This first byte is decoded by a decoder 10 at the input of the register 1, and the decoded attribute value is held in the relevant group of bit positions allotted to that attribute. One bit of the attribute byte serves as an attribute pointer bit Ap in response to which the control logic 7 causes the next attribute byte held in the register 5 to be fed to the register 1 for decoding. This process continues until the attribute pointer bit Ap indicates that there are no further attributes in that group. This first group of attributes is thus fully accummulated in the register 1 whose contents are then written into the relevant character position as fully explicit attribute data for that position. The control signals Cs4 signifies the stepping of the register 5 by the control logic 7.

The pertaining fill register 1 is not cleared between the processing of the attributes data for successive character positions. Therefore, once an attribute is set at a given character position, the attribute value will remain in the register 1 and hence the attribute will be set at each succeeding character position of the character row until either a contradictory attribute is set at a subsequent character position or until the end of the row.

I claim:

1. A data display apparatus for displaying on the screen of a raster scan display device data represented by digital codes, the displayed data being composed of discrete characters arranged in character rows each including a number of character positions, said digital codes representing both character data which identifies character shape and attribute data which identifies at least one attribute to be applied to displayed characters, the apparatus comprising:

means for selectively displaying characters with their attributes in accordance with the received data, said selective character display means including attribute converter means for converting attribute data which relates to serial and non-spacing attributes into fully explicit attribute data in respect of each character position, the attribute data for a given character position in a row having one or more items which pertain(s) to the character at that position and to each successive position in said row until either a contradictory attribute is set at a subsequent character position in said row or until the end of said row, said attribute converter means including a row buffer which is connected to receive the character data and which has a capacity for holding the entire character data for all the character positions of a row of characters;

wherein said attribute data, prior to conversion, is in stack-coded form and the capacity of said row buffer is sufficient for additionally holding the explicit attribute data for all the character positions of the row; and wherein said attribute converter means additionally includes: an attribute register connected to receive the stack-coded attribute data; a fill register which can hold all the explicit attribute data that may be required at a character position; and control logic means which controls said fill register to receive each group of stack-coded attribute data in turn from said attribute register, each item of a group of stack-coded attribute data fed to said fill register from said attribute register including a control bit for signifying whether there is another item of said group still remaining in said attribute register; said control logic means being responsive to the control bit of each item of said group so that when such control bit signifies a remaining item said control logic means causes said fill register to receive a remaining item of said group from said attribute register.

2. A data display apparatus as claimed in claim 1, wherein said fill register includes decoder means for converting each item of each received group of stack-coded attribute data into explicit attribute data; and wherein said attribute converter additionally comprises means for addressing each character position of said row buffer in turn to feed thereto the explicit attribute data that pertains in said fill register, which explicit attribute data, once it is set at a given character position, remains pertaining in said fill register for feeding into each successive character position until either a contradictory attribute is set at a subsequent character position in the row or until the end of the row.

3. A data display apparatus as claimed in claim 2, wherein a bit of the character data fed to each character position of said row buffer is used to signify to the control logic means whether or not a group of stack-coded attribute data is to be set at the position.

4. A data display apparatus as claimed in claim 1, 2, or 3, wherein said row buffer is one of two row buffers which function alternately as either a "fill" row buffer for receiving character and explicit attribute data for a character row, or as a "display" row buffer for providing such previously received data for the display of the preceding character row.

* * * * *